US008470752B2

(12) United States Patent
Donaghy et al.

(10) Patent No.: US 8,470,752 B2
(45) Date of Patent: Jun. 25, 2013

(54) AUTOMOTIVE LUBRICANT COMPOSITION

(75) Inventors: Christopher Donaghy, Newark, DE (US); Robert Bruce Calvert, Lawrenceville, NJ (US); Andrew Simon Oldfield, Saltburn by Sea (GB)

(73) Assignees: Croda Americas LLC, Wilmington, DE (US); Croda International PLC, Goole, East Yorkshire (GB)

( * ) Notice: Subject to any disclaimer, the term of this patent is extended or adjusted under 35 U.S.C. 154(b) by 0 days.

(21) Appl. No.: 13/472,021

(22) Filed: May 15, 2012

(65) Prior Publication Data

US 2013/0017985 A1 Jan. 17, 2013

Related U.S. Application Data

(63) Continuation of application No. 11/150,473, filed on Jun. 13, 2005, now abandoned.

(60) Provisional application No. 60/578,899, filed on Jun. 14, 2004.

(51) Int. Cl.

| | |
|---|---|
| ***C10M 105/38*** | (2006.01) |
| ***C10M 101/04*** | (2006.01) |
| ***C08K 5/29*** | (2006.01) |

(52) U.S. Cl.
USPC ..... 508/485; 508/486; 508/551; 508/591

(58) Field of Classification Search
USPC ..... 508/485, 486, 551, 591
See application file for complete search history.

(56) References Cited

U.S. PATENT DOCUMENTS

| | | | |
|---|---|---|---|
| 6,074,993 | A | 6/2000 | Waddoups et al. |
| 6,333,298 | B1 | 12/2001 | Waddoups et al. |
| 6,723,685 | B2 | 4/2004 | Hartley et al. |
| 7,214,648 | B2 | 5/2007 | Saini et al. |
| 2002/0137636 | A1 | 9/2002 | Hartley et al. |
| 2003/0027730 | A1 | 2/2003 | Field et al. |
| 2003/0119682 | A1 | 6/2003 | Saini et al. |
| 2003/0199399 | A1 | 10/2003 | Hartley et al. |
| 2004/0198614 | A1 | 10/2004 | Calder |

FOREIGN PATENT DOCUMENTS

| | | |
|---|---|---|
| WO | WO 03/031543 | 4/2003 |

*Primary Examiner* — Ellen McAvoy
*Assistant Examiner* — Vishal Vasisth
(74) *Attorney, Agent, or Firm* — Jones Day

(57) ABSTRACT

Lubricant compositions for use in automotive engine oils comprising a combination of a specific base stock or mixture of base stocks and a friction reducing additive to improve fuel economy and fuel economy longevity of the automotive engine oil. The friction reducing additive is a specific partial polyol ester and may also include a specific saturated primary amide.

32 Claims, No Drawings

AUTOMOTIVE LUBRICANT COMPOSITION

CROSS REFERENCE TO RELATED APPLICATION

This application is a continuation of U.S. application Ser. No. 11/150,473, filed Jun. 13, 2005, now abandoned, which claims benefit of U.S. Provisional Ser. No. 60/578,899, filed Jun. 14, 2004. The foregoing related applications, in their entirety, are incorporated herein by reference.

TECHNICAL FIELD OF THE INVENTION

The present invention relates to lubricant compositions for use in automotive engine oils comprising a base stock and a friction reducing additive to improve fuel economy and fuel economy longevity of the automotive engine oil.

BACKGROUND OF THE INVENTION

Automotive engine oils typically comprise a lubricant base stock and an additive package, both of which can contribute significantly to the properties and performance of the automotive engine oil.

The choice of lubricant base stock can have a major impact on properties such as oxidation and thermal stability, volatility, low temperature fluidity, solvency of additives, contaminants and degradation products, and traction. The American Petroleum Institute (API) currently defines six groups of lubricant base stocks (API Publication 1509).

Groups I, II and III are mineral oils which are classified by the amount of saturates and sulphur they contain and by their viscosity indices.

Table One below illustrates these API classifications for Groups I, II and III.

TABLE ONE

| Group | Saturates | Sulphur | Viscosity Index |
|---|---|---|---|
| I | <90% | >0.03% | 80-120 |
| II | At least 90% | Not more than 0.03% | 80-120 |
| III | At least 90% | Not more than 0.03% | At least 120 |

Group I base stocks are solvent refined mineral oils, which are the least expensive base stock to produce, and currently account for the majority of base stock sales. They provide satisfactory oxidation stability, volatility, low temperature performance and traction properties and have very good solvency for additives and contaminants. Group II base stocks are mostly hydroprocessed mineral oils, which typically provide improved volatility and oxidation stability as compared to Group I base stocks. They also respond differently to additives as compared to Group I base stocks. The use of Group II stocks has grown to about 30% of the US market. Group III base stocks are severely hydroprocessed mineral oils or they can be produced via wax or paraffin isomerisation. They are known to have better oxidation stability and volatility than Group I and II base stocks but have a limited range of commercially available viscosities.

Group IV base stocks differ from Groups I to III in that they are synthetic base stocks i.e. polyalphaolefins (PAOs). PAOs have good oxidative stability, volatility and low pour points. Disadvantages include moderate solubility of polar additives, for example antiwear additives Group VI base stocks are polyinternalolefins (PIOs), which are of a similar chemistry to PAOs in that both are manufactured by the oligomerisation of linear olefins. They offer similar performance in engine tests to Group III and Group IV base stocks and are slightly inferior to PAOs in terms of viscosity index, volatility, and low temperature properties.

Group V base stocks are all base stocks that are not included in the other Groups. Examples include alkyl naphthalenes, alkyl aromatics, vegetable oils, esters (polyol esters, diesters and monoesters), polycarbonates, silicone oils and polyalkylene glycols.

To create a suitable engine oil, additives are blended into the chosen base stock. The additives either enhance the stability of the lubricant base stock or provide additional protection to the engine. Examples of engine oil additives include antioxidants, antiwear agents, detergents, dispersants, viscosity index improvers, defoamers and pour point depressants, friction reducing additives.

One area of concern for automotive engines is around reduction of fuel consumption and energy efficiency. It is well known that the automotive engine oil has a significant part to play in the overall energy consumption of automotive engines. Automotive engines can be thought of as consisting of three discreet but connected mechanical assemblies which together make up the engine, the valve train, the piston assembly, and the bearings. Energy losses in mechanical components can be analysed according to the nature of the friction regime after the well known Stribeck curve. Predominant losses in the valve train are boundary and elastohydrodynamic, in the bearings are hydrodynamic, and the pistons hydrodynamic and boundary. Hydrodynamic losses have been gradually improved by the reduction of automotive engine oil viscosity (e.g. 5W30 instead of 10W30 viscosity grades). Elastohydrodynamic losses can be improved by careful selection of the base stock type, taking into account the traction coefficient of the base stock. Boundary losses can be improved by careful selection of friction reducing additive. Careful selection of both base stock and friction reducing additive is therefore important, but it is not as simple as choosing the best base stock for hydrodynamic and elastohydrodynamic properties, and then choosing a friction reducing additive which is known to be active in the boundary regime. The interaction of base stock, friction reducing additive and other additives needs to be considered.

Friction reducing additives that have been used to improve fuel economy fall into three main chemically-defined categories, which are organic, metal organic and oil insoluble. The organic friction-reducing additives themselves fall within four main categories which are carboxylic acids or their derivatives, which includes partial esters, nitrogen-containing compounds such as amides, imides, amines and their derivatives, phosphoric or phosphonic acid derivatives and organic polymers. In current commercial practice examples of friction reducing additives are glycerol monooleate and oleylamide, which are both derived from unsaturated fatty acids.

While initial fuel economy requirements, for which the above friction reducing additives were designed, focused only on the fresh oil, new engine oil specifications have now been developed that also address fuel economy longevity. A good example is Sequence VI-B, an engine test, which has been developed for the ILSAC GF-3 specification. For the ILSAC GF-4 specification, Sequence VI-B includes ageing stages of 16 and 80 hours in order to determine fuel economy longevity as well as fuel economy. These ageing stages are equivalent to 4000-6000 miles of mileage accumulation required prior to the EPA Metro/Highway Fuel economy test. That test is used in determining the Corporate Average Fuel Economy (CAFE) regulation parameter for a vehicle.

WO03/031543 discloses a range of saturated friction reducing additives chosen from saturated amides themselves and in combination with saturated polyol esters, to address these fuel economy longevity requirements alongside the fuel economy requirements. However there is no disclosure of any optimising of the combination of these saturated friction reducing additives with base stock. There is only a general disclosure of choice of base stocks.

Accordingly, there remains a need for a lubricant composition for automotive engine oils comprising a combination of a specifically chosen base stock and a specifically chosen friction reducing additive designed to meet the fuel economy and fuel economy longevity requirements.

SUMMARY OF THE INVENTION

It has been found when certain base stocks and certain friction modifiers are combined in an automotive engine oil there is an improvement in fuel economy and fuel economy longevity.

The present invention relates to a lubricant composition for use in an automotive engine oil comprising a) a base stock which comprises as a major component at least one of a Group III, Group IV and Group VI base stock wherein the Group nomenclatures are as defined by the American Petroleum Institute;

b) 0.01-5% of a partial polyol ester friction reducing additive derived from the reaction of either glycerol or trimethylolpropane with a monocarboxylic acid of formula $R^1COOH$, where $R^1$ is a straight or branched chain aliphatic hydrocarbon group with 12-22 carbon atoms, the monocarboxylic acid having an iodine value of not more than 20 and a cloud point of not more than 45° C.; and c) optionally 0.01-5% of a saturated primary amide friction reducing additive of formula $R^2CONH_2$ where $R^2$ is a straight or branched chain aliphatic hydrocarbon group with 12-22 carbon atoms;

wherein the oxidative induction time of the friction reducing additive in (B), together with the friction reducing additive in (C) if present, is at least 25 minutes, said oxidative induction time being measured using a high pressure differential scanning calorimeter after carrying out the steps comprising placing 5 mg of the friction reducing additive with 0.5% by weight of a phenolic antioxidant having a thioether group relative to the friction reducing additive in a 40 μl aluminium crucible and heating the calorimeter from 30° C. to 170° C. at a rate of 50° C./min followed by maintenance of the temperature at 170° C. with an air pressure of 40 bar and air flow of 50 ml/min.

The base stock comprises as a major component at least one of a Group III, Group IV and Group VI base stock wherein the Group nomenclatures are as defined by the American Petroleum Institute. Therefore, as applied to the present invention, Group III base stocks are severely hydroprocessed mineral oils or mineral oils that can be produced via wax or paraffin isomerisation. Group IV base stocks are polyalphaolefins (PAOs) and Group VI base stocks are polyinternalolefins (PIOs).

By major component, it is meant at least 50% by weight of base stock. By minor component, it is meant less than 50% by weight of base stock.

In another aspect of the invention is a method of lubricating an automotive engine oil using a lubricant composition comprising a) a base stock which comprises as a major component at least one of a Group III, Group IV and Group VI base stock wherein the Group nomenclatures are as defined by the American Petroleum Institute;

b) 0.01-5% of a partial polyol ester friction reducing additive derived from the reaction of either glycerol or trimethylolpropane with a monocarboxylic acid of formula $R^1COOH$, where $R^1$ is a straight or branched chain aliphatic hydrocarbon group with 12-22 carbon atoms, the monocarboxylic acid having an iodine value of not more than 20 and a cloud point of not more than 45° C.; and c) optionally 0.01-5% of a saturated primary amide friction reducing additive of formula $R^2CONH_2$ where $R^2$ is a straight or branched chain aliphatic hydrocarbon group with 12-22 carbon atoms;

wherein the oxidative induction time of the friction reducing additive in (B), together with the friction reducing additive in (C) if present, is at least 25 minutes, said oxidative induction time being measured using a high pressure differential scanning calorimeter after carrying out the steps comprising placing 5 mg of the friction reducing additive with 0.5% by weight of a phenolic antioxidant having a thioether group relative to the friction reducing additive in a 40 μl aluminium crucible and heating the calorimeter from 30° C. to 170° C. at a rate of 50° C./min followed by maintenance of the temperature at 170° C. with an air pressure of 40 bar and air flow of 50 ml/min.

DETAILED DESCRIPTION OF THE INVENTION

The base stock comprises as a major component at least one of a Group III, Group IV and Group VI base stock, preferably at least one of a Group III or Group IV base stock, more preferably a Group III base stock. By major component, it is meant at least 50% by weight of base stock, preferably at least 65%, more preferably at least 75%. The Group III base stock preferably has a viscosity at 100° C. of 3 to 10 $mm^2/s$, more preferably 4 to 8 $mm^2/s$. It has a viscosity index of at least 120, preferably at least 125. It exhibits a Noack evaporation loss, determined according to European standard CEC L-40-T-82, of less than 20%, more preferably less than 15%. Group III base stocks vary widely in naphthene content from essentially zero to about 70% depending on the process, such as wax isomerization or hydrocracking, and the specific refinery configuration in which they are made. The corresponding paraffin and iso-paraffin content varies from essentially 100% to 30%. Group III stocks with higher paraffin and iso-paraffin content and lower naphthene content are preferred, more preferably those with a naphthene content below 50%.

The Group IV base stock preferably has a viscosity at 100° C. of 3 to 10 $mm^2/s$, more preferably 4 to 8 $mm^2/s$. It has a viscosity index of at least 120, preferably at least 125. It exhibits a Noack evaporation loss, determined according European standard CEC L-40-T-82, of less than 20%, more preferably less than 15%.

The base stock may also comprise as a minor component, preferably less than 30%, more preferably less than 20%, especially less than 10%, of any or a mixture of Group I, II and/or Group V base stocks and/or any one or a mixture of Group III, Group IV and Group VI base stocks which have not been used as the major component in the base stock.

As applied to the present invention Group I base stocks are solvent refined mineral oils, Group II base stocks are hydroprocessed mineral oils and Group V base stocks are all base stocks that are not included in the other five Groups. Examples of Group V base stocks include alkyl naphthalenes, alkyl aromatics, vegetable oils, esters, for example, monoesters, diesters and polyol esters, polycarbonates, silicone oils and polyalkylene glycols. Preferred Group V base stocks are alkyl naphthalenes and esters, with alkyl naphthalenes being especially preferred. Preferred types of ester include polyol esters derived from reaction of trimethylolpropane with monocarboxylic acids having 6 to 18 carbon atoms, diesters based on adipic acid and dimer acid with branched monoalcohols having 8 to 13 carbon atoms and monoesters derived from reaction of isostearic acid with monoalcohols having at least 18 carbon atoms.

The base stock may also comprise as a minor component, preferably less than 15%, of a viscosity index improver, itself having a viscosity at 100° C. of 20-4000 $mm^2/s$. Examples of viscosity index improver include high viscosity PAO, with a viscosity range at 100° C. of 25 $mm^2/s$ to 3000 $mm^2/s$.

Particularly preferred base stocks include firstly a mixture of Group III (70 to 95% by wt) with Group V alkyl naphthalene or ester (preferably diester or polyol ester) (0 to 20%) and high viscosity PAO (2% to 10%) and secondly, a mixture of Group IV (60 to 90%) with Group V alkyl naphthalene or ester (preferably diester or polyol ester (5 to 20%) and high viscosity PAO (2 to 10%).

The partial polyol ester is derived from the reaction of trimethylolpropane or glycerol with a monocarboxylic acid of formula $R^1COOH$, where $R^1$ is a straight or branched chain aliphatic hydrocarbon group with 12-22, preferably 12-18, especially 14-18 carbon atoms.

The monocarboxylic acid has an iodine value of not more than 20, preferably not more than 15 and especially not more than 10, and a cloud point of not more than 45° C. Preferred examples of the monocarboxylic acid include the straight chained acids of dodecanoic and tetradecanoic and mixtures thereof, the branched chain acid of isostearic and the mixture of straight and branched chain, saturated and unsaturated acids with typically 18 carbon atoms, named monomeric acid, which is the C18 monomer by-product resulting from the dimerisation of oleic acid. Particularly preferred monocarboxylic acids are isostearic and monomeric acid.

Preferred partial polyol esters include an ester, which is the reaction product of either glycerol or trimethylolpropane, with a C14-C18 monocarboxylic acid having an iodine value not more than 20, preferably not more than 15 and especially not more than 10 and a cloud point of not more than 45° C., preferably isostearic acid or monomeric acid, where the product ester is a mono or diester or a mixture thereof, preferably a monoester.

The polyol ester may be derived by direct esterification of an acid, acid chloride or acid anhydride with glycerol or trimethylolpropane or it may be derived by transesterification of an ester with glycerol or trimethylolpropane. Preferably, it is derived by direct esterification of an acid with glycerol or trimethylolpropane.

The partial polyol ester is present at a level of 0.01 to 5%, preferably 0.01 to 2%, more preferably 0.1 to 1.5% in the lubricant composition.

The saturated primary amide friction reducing additive is of formula $R^2CONH_2$ where $R^2$ is a straight or branched chain aliphatic hydrocarbon group with 12-22, preferably 12-20, more preferably 12-18, especially 14-18 carbon atoms. Examples of the saturated aliphatic amide include capryl amide, lauryl amide, myristyl amide, palmityl amide, stearyl amide, isostearyl amide, arachidyl amide, behenyl amide and lignoceryl amide. A particularly preferred saturated primary amide is isostearylamide. The saturated primary amide may be derived from ammonolysis of an ester, acid chloride or acid anhydride.

The saturated primary amide when present is at a level of 0.01 to 5%, preferably 0.01 to 2%, more preferably 0.05 to 1.5%, in the lubricant composition.

When the saturated primary amide is present a preferred combination of friction reducing additive is 0.5% partial polyol ester with 0.5% saturated primary amide.

When the saturated primary amide is present the ratio of partial polyol ester to saturated primary amide ranges from 95:5 wt % to 5:95 wt %, more preferably from 80:20 to 20:80 and particularly from 60:40 to 40:60. Particularly preferred ratios include a 50:50 wt % ratio of glycerol monoisostearate to isostearylamide, and a 50:50 wt % ratio of trimethylolpropane monomonomerate to isostearylamide, when the saturated primary amide is present.

The oxidative induction time of the friction-reducing additive in (B), together with (C) if present, is at least 25 minutes, preferably at least 30, more preferably at least 35 minutes, said oxidative induction time being measured using a high pressure differential scanning calorimeter after carrying out the steps comprising placing 5 mg of the friction-reducing additive with 0.5% by weight of phenolic antioxidant with a thioether group, for example, Irganox TM L115 available ex Ciba Speciality Chemicals, relative to the friction-reducing additive in a 40 μl aluminium crucible and heating the calorimeter from 30° C. to 170° C. at a rate of 50° C./min followed by maintenance of the temperature at 170° C. with an air pressure of 40 bar and air flow of 50 ml/min.

The lubricant composition may also comprise other additives of known functionality at levels between 5 to 20%, more preferably between 7 to 18% and particularly between 10 to 16% of the total weight of the lubricant composition. Suitable additives include detergents, dispersant, antiwear additives, viscosity modifiers, anticorrosion additives, antifoam, pour point depressants and the like.

The lubricant composition is designed for use in automotive engine oils.

By automotive engine oils, it is meant both gasoline and diesel (including heavy duty diesel) engine oils.

The following examples are intended to be illustrative of the present invention. Other objects and advantages of the present invention will become apparent to those skilled in the art from the detailed description. As will be realized, the present invention is capable of other and different embodiments, and its several details are capable of modifications in various apparent respects, without departing from the scope and spirit of the present invention. Accordingly, the description is to be regarded as illustrative in nature and not as restrictive.

EXAMPLES

Example One

In order to measure changes in power output (engine efficiency) with changes to the base stock and friction reducing additive, torque was measured from a crankshaft of a 5.7 L General Motors gasoline engine having a nominal maximum power output of about 400 horsepower. The engine was connected to a dynamometer on a test stand. Torque was measured at 200 revolutions per minute (rpm) increments over the range 1600-5000 rpm and converted to useful work or horsepower. The oil sump temperature was controlled with a heat exchanger such that the temperature of the oil at the inlet to the oil pump was 170° F. This was chosen as being representative of engine oil temperatures at highway speeds. The temperature of the oil at the outlet was 200° F. and the oil pressure 90 psi. An engine oil meeting ILSAC GF-3 specifications and containing a Group I base stock was used as a reference. Four runs were made with the reference oil to break in the engine and to establish a base line of performance. The GF-3 reference oil was also run after each test oil to verify that the base line did not change. The engine was flushed with test oil before each run. A series of four test oils were blended to 10W30 viscosity specifications. Two of the test oils were made with a Group II base stock; two were made using a 90:10 blend of Nexbase™ Group III (available ex Fortum Oil):Group IV base stocks. The same additive package, a package capable meeting GF-4 specifications but without a friction reducing additive, was used at the same dosage in all of the four test oils. An additive, specifically a 1% by weight of a friction reducing additive, was added to each oil. The results are reported in Table Two.

TABLE TWO

| Base stock and friction reducing additive combination in the lubricant composition | Average Power Output (% gain) |
|---|---|
| A: Group III/IV base stock with additive package and 1% glycerol monoisostearate (GMIS) | +0.30 |
| B: Group III/IV base stock with additive package and 1% mixture of glycerol monoisostearate/ isostearylamide (50/50 wt %) (GMIS/ISA) | +0.81 |
| C: Group II base stock with additive package and 1% GMIS (comparative) | −0.22 |
| D: Group II base stock with additive package and 1% mixture of GMIS/ISA (50/50 wt %) (comparative) | +0.12 |

The lubricant compositions in A and B respectively have viscosities at 100° C. of 10.68 and 10.65 $mm^2/s$ and viscosity indexes of 150 and 149.

The data in Table Two clearly illustrates that a lubricant composition according to the present invention (see Example 4 below which illustrates oxidative stability data for the friction reducing additives) has significantly greater average power output than a lubricant composition outside the scope of the present invention. Automotive engine efficiency tests can measure fuel economy directly, or indirectly. In the direct mode, the engine is programmed to run a defined/certain power out cycle (e.g. to simulate motorway driving), and the amount of fuel consumed to meet the required power output is measured, normally gravimetrically. In the indirect mode, a certain/defined amount of fuel is consumed per unit time, and the resulting power out is measured. Since the difference between the input and the output is a measure of the efficiency of the engine, the engine test, which measures power output, indirectly measures fuel efficiency also. The engine efficiency data shown is an example of an indirect fuel economy measurement by the measurement of power output.

Example 2

A fuel economy engine test, according to European standard CEC L-54-T-96, was undertaken for a Mercedes Benz M111 two-liter gasoline injection engine with four valves per cylinder using a 5W-30 lubricant composition comprising 79% of a Group III base stock (Nexbase™ 3043—a colourless, catalytically hydroisomerised and dewaxed base oils comprising of hydrogenated, highly isoparaffinic hydrocarbons available ex Fortum, having a viscosity index of at least 121 and a viscosity at 100° C. of 4.2-4.4 $mm^2/s$), 11.3% of an ACEA A1/B1 and API SL capable additive package without a friction reducing additive, 8.2% of Lubrizol 7077 viscosity index improver and 1.5% of friction reducing additive.

Table Three below illustrates the fuel economy improvement results as compared to a RL191 (15W-40) reference oil as defined in CEC L-54-T-96.

TABLE THREE

| Base Stock | Friction Reducing Additive | Iodine Value and Cloud Point (respectively) of Acid from Which Ester is Derived | | Fuel Economy Improvement (%) |
|---|---|---|---|---|
| Nexbase ™ 3043 | GMIS/ISA (50/50 mixture) | 8 max | <8 | 2.51 |
| Nexbase ™ 3043 | Trimethylolpropane monomonomerate/ Isostearylamide (50/50 mixture) (TMPMM/ISA) | 5 max | 40 | 2.66 |
| Nexbase ™ 3043 | Comparative - Glycerol monoisostearate/ Monamid AD-150 (50/50 mixture) (GMIS/AD-150) | 8 max | <8 | 2.11 |
| Nexbase ™ 3043 | Comparative - Glycerol mono-oleate (GMO) | 89-97 | <7 | 2.16 |
| Nexbase ™ 3043 | Comparative - no additive | | | 1.96 |

Monamid AD-150 is an amide derived from reaction of diethanolamine with coconut oil and is available ex Texaco.

The data in Table Three is indicative of an improvement in fuel economy when a base stock according to the present invention and a friction reducing additive according to the present invention are used together in a lubricant composition for automotive engine oils. This is as compared to use of the base stock with different friction reducing additives and sole use of the base stock.

Example 3

Fuel economy and fuel economy longevity was measured as detailed below. The coefficient of friction of a lubricant composition as described in Example 2 was determined over two cycles of a temperature range of 40 to 140° C. using a pin-on-ring tribometer. The ring is a 100Cr6 stainless steel ring of 730 mm diameter and the pin is a cylinder of the same material of 8 mm diameter, the pin having flexible ends so that each end can bend slightly to allow full alignment with the ring. The load applied was 100N and the speed of rotation was 0.03 m/s to ensure that the system operates under boundary lubrication. The results are illustrated in Table Four below.

TABLE FOUR

| | | Friction Coefficient for Addition of Friction Reducing Additive | | | |
|---|---|---|---|---|---|
| Temp (° C.) | No Friction Reducing Additive | TMPMM/ISA (50/50) | GMIS/ISA (50/50) | COMPAR. GMIS/AD-150 (50/50) | COMPAR GMO |
| 40 (1st cycle) | 0.11684 | 0.09814 | 0.09797 | 0.10205 | 0.09602 |
| 50 | 0.12045 | 0.09832 | 0.09789 | 0.10512 | 0.09652 |
| 60 | 0.11984 | 0.09818 | 0.09788 | 0.10774 | 0.09639 |

TABLE FOUR-continued

| | | Friction Coefficient for Addition of Friction Reducing Additive | | | |
|---|---|---|---|---|---|
| Temp (° C.) | No Friction Reducing Additive | TMPMM/ISA (50/50) | GMIS/ISA (50/50) | COMPAR. GMIS/AD-150 (50/50) | COMPAR GMO |
| 70 | 0.11974 | 0.09853 | 0.09768 | 0.11082 | 0.10005 |
| 80 | 0.12244 | 0.09982 | 0.09842 | 0.11396 | 0.10289 |
| 90 | 0.12269 | 0.10069 | 0.10078 | 0.11632 | 0.10538 |
| 100 | 0.12391 | 0.10128 | 0.10183 | 0.11923 | 0.10824 |
| 110 | 0.12581 | 0.10281 | 0.10376 | 0.12206 | 0.11094 |
| 120 | 0.12827 | 0.10329 | 0.10620 | 0.12537 | 0.11341 |
| 130 | 0.13240 | 0.10468 | 0.10966 | 0.12841 | 0.11490 |
| 140 (1st cycle) | 0.14210 | 0.10515 | 0.11226 | 0.13088 | 0.11702 |
| 130 | 0.13771 | 0.10218 | 0.10873 | 0.12627 | 0.11533 |
| 120 | 0.13352 | 0.10024 | 0.10641 | 0.12189 | 0.11452 |
| 110 | 0.12807 | 0.09877 | 0.10398 | 0.11866 | 0.11306 |
| 100 | 0.12548 | 0.09809 | 0.10216 | 0.11570 | 0.11231 |
| 90 | 0.12283 | 0.09800 | 0.10095 | 0.11363 | 0.11234 |
| 80 | 0.12164 | 0.09749 | 0.09989 | 0.11190 | 0.11035 |
| 70 | 0.12001 | 0.09685 | 0.09870 | 0.11012 | 0.10780 |
| 60 | 0.11882 | 0.09658 | 0.09806 | 0.10830 | 0.10589 |
| 50 | 0.11790 | 0.09645 | 0.09805 | 0.10616 | 0.10385 |
| 40 (2nd cycle) | 0.12027 | 0.09580 | 0.09844 | 0.10219 | 0.09926 |
| 50 | 0.12161 | 0.09654 | 0.09996 | 0.10631 | 0.10065 |
| 60 | 0.12300 | 0.09696 | 0.10048 | 0.10929 | 0.10433 |
| 70 | 0.12309 | 0.09848 | 0.10105 | 0.11243 | 0.10797 |
| 80 | 0.12335 | 0.10012 | 0.10213 | 0.11560 | 0.10973 |
| 90 | 0.12611 | 0.10107 | 0.10356 | 0.11791 | 0.11205 |
| 100 | 0.12904 | 0.10182 | 0.10479 | 0.12011 | 0.11448 |
| 110 | 0.13221 | 0.10319 | 0.10603 | 0.12268 | 0.11702 |
| 120 | 0.13578 | 0.10449 | 0.10864 | 0.12471 | 0.11929 |
| 130 | 0.14030 | 0.10577 | 0.11127 | 0.12713 | 0.12235 |
| 140 (2nd cycle) | 0.14526 | 0.10728 | 0.11342 | 0.12903 | 0.12150 |

Friction coefficients for lubricant compositions having the combination of base stock and friction reducing additive according to the present invention are lower than that of lubricant compositions with the base stock only, and that of the comparative examples of lubricant compositions having base stock with friction reducing additive, across the temperature range. These friction coefficients are indicative of enhanced fuel economy.

For fuel economy longevity, comparison is made of the friction coefficients at 40° C. in the first and second cycle and at 140° C. in both these cycles. Lubricant compositions having the combination of base stock and friction reducing additive according to the present invention have friction coefficients at 40 and 140° C. that are maintained from the first to the second cycle. This is indicative of fuel economy longevity. Comparative data for the lubricant composition having base stock only and the base stock in combination with GMO illustrates an increase in the friction coefficients at both 40 and 140° C. from the first to the second cycle. Data for the lubricant composition having base stock of the present invention in combination with comparative GMIS/AD-150 has friction coefficients at 40 and 140° C. that are maintained from the first to the second cycle but this combination has already been ruled out with the respect to fuel economy as the friction coefficients are much higher than those of the present invention across the temperature range.

Example 4

The oxidative stability of various friction reducing additives according to the invention was measured as follows.

The induction time in minutes, i.e. the time up to when oxidation of the friction reducing additive starts, was measured by high pressure differential scanning calorimetry (DSC) of various friction-reducing additives, each with 0.5% by weight antioxidant (Irganox L115—ex Ciba Speciality Chemicals) present, using a Mettler DSC27HP with a Mettler TC 15 TA controller, under the following test conditions:

| | |
|---|---|
| Start temperature: | 30° C. |
| Heating rate: | 50° C./min till test temperature of 170° C. |
| Air pressure: | 40 bar Airflow: 50 ml/min |
| Sample quantity: | 5 +/− 0.4 mg |
| Crucible: | Aluminium type, 40 μl |

The results are illustrated in Table Five below.

TABLE FIVE

| Friction Reducing Additive | Induction Time (Minutes) |
|---|---|
| GMIS | 47 |
| GMIS/ISA (50:50% wt/wt) | 45 |
| TMPMM/ISA (50/50) | 53 |
| GMIS/AD-150 (50/50) (Comparative) | 51 |
| Oleylamide (Comparative) (OLA) | 11 |
| GMO (Comparative) | 4 |

The data in Table Five clearly illustrates that the friction reducing additives according to the present invention have significantly enhanced oxidative stability as compared to the commercially available friction reducing additives specified. This enhanced oxidative stability is indicative of potential fuel economy longevity. GMIS/AD-150, which is a comparative friction reducing additive according to the present invention, has a high oxidative stability itself as illustrated in Table Five above. However, it is clearly illustrated in Examples 2 and 3 above that, when present in a lubricant composition in combination with the base stock of the present invention, the fuel economy is not acceptable.

What is claimed is:

1. A method of lubricating an automotive engine using a lubricant composition comprising:

(A) a Group III base stock as a major component, having a viscosity at 100° C. of 3 to 10 $mm^2/s$, a viscosity index of at least 120, and a Noack evaporation loss of less than 20%;

(B) 0.1-2% of a partial polyol ester friction reducing additive derived from the reaction of either glycerol or trimethylolpropane with a monocarboxylic acid of formula $R^1COOH$, where $R^1$ is a straight or branched chain $C_{12}$-$C_{18}$ aliphatic hydrocarbon group, the monocarboxylic acid having an iodine value of not more than 20 and a cloud point of not more than 45° C.; and (C) a saturated primary amide friction reducing additive of formula $R^2CONH_2$ where $R^2$ is a straight or branched chain $C_{12}$-$C_{18}$ aliphatic hydrocarbon group, wherein the ratio of the partial polyol ester to the saturated primary amide ranges from 60:40 wt. % to 40:60 wt. %;

wherein the oxidative induction time of the friction reducing additive in (B), together with the friction reducing additive in (C), is at least 25 minutes, said oxidative induction time being measured using a high pressure differential scanning calorimeter after carrying out the steps comprising placing 5 mg of the friction reducing additive with 0.5% by weight of a phenolic antioxidant having a thioether group relative to the friction reducing additive in a 40 μl aluminium crucible and heating the calorimeter from 30° C. to 170° C. at a rate of 50° C./min followed by maintenance of the temperature at 170° C. with an air pressure of 40 bar and air flow of 50 ml/min.

2. The method of claim 1, wherein the Group III base has a viscosity at 100° C. of 4-8 $mm^2/s$, a viscosity index of at least 125 and a Noack evaporation loss of less than 15%.

3. The method of claim 1, wherein the lubricant composition further comprises as a minor component less than 30 wt. % of any or a mixture of Group I, II, IV, V, and/or Group VI base stocks and/or any or a mixture of Group III base stocks which have not been used as the major component in the base stock.

4. The method of claim 1, wherein the lubricant composition further comprises 5-20 wt. % of a Group V alkyl naphthalene or ester base stock.

5. The method of claim 1, wherein the lubricant composition comprises 0.1-1.5 wt. % of the partial polyol ester friction reducing additive.

6. The method of claim 1, wherein the lubricant composition comprises 0.5-1.5 wt. % of the saturated primary amide friction reducing additive.

7. The method of claim 1, wherein the lubricant composition comprises 0.1-1.5 wt. % of the partial polyol ester friction reducing additive and 0.5-1.5 wt. % of the saturated primary amide friction reducing additive.

8. The method of claim 1, wherein the lubricant composition comprises 0.5 wt. % of the partial polyol ester friction reducing additive and 0.5 wt. % of the saturated primary amide friction reducing additive.

9. The method of claim 1, wherein the lubricant composition further comprises as a minor component less than 15% of a viscosity index improver having a viscosity at 100° C. of 20 to 4000 $mm^2/s$.

10. The method of claim 1, wherein the partial polyol ester friction reducing additive is the reaction product of either glycerol or trimethylolpropane with a $C_{14}$-$C_{18}$ monocarboxylic acid having an iodine value of not more than 10 and a cloud point of not more than 45° C. wherein the product ester is a monoester or diester or a mixture thereof.

11. The method of claim 1, wherein the saturated primary amide friction reducing additive comprises a straight or branched chain $C_{14}$-$C_{18}$ aliphatic hydrocarbon group.

12. The method of claim 1, wherein the saturated primary amide friction reducing additive is isostearylamide.

13. The method of claim 1, wherein the ratio of partial polyol ester friction reducing additive to saturated primary amide friction reducing additive is 50:50 wt. %.

14. The method of claim 1, wherein the lubricant composition further comprises between 5 to 20 wt. % other additives, relative to the total weight of the lubricant composition.

15. A method of improving fuel economy and fuel longevity, comprising lubricating an automotive engine with a lubricant composition comprising:

(A) a Group III base stock as a major component, having a viscosity at 100° C. of 3 to 10 $mm^2/s$, a viscosity index of at least 120, and a Noack evaporation loss of less than 20%;

(B) 0.1-2 wt. % of a partial polyol ester friction reducing additive derived from the reaction of either glycerol or trimethylolpropane with a monocarboxylic acid of formula $R^1COOH$, where $R^1$ is a straight or branched chain $C_{12}$-$C_{18}$ aliphatic hydrocarbon group, the monocarboxylic acid having an iodine value of not more than 20 and a cloud point of not more than 45° C.; and (C) a saturated primary amide friction reducing additive of formula $R^2CONH_2$ where $R^2$ is a straight or branched chain $C_{12}$-$C_{18}$ aliphatic hydrocarbon group, wherein the ratio of the partial polyol ester to the saturated primary amide ranges from 60:40 wt. % to 40:60 wt. %;

wherein:

i) the oxidative induction time of the friction reducing additive in (B), together with the friction reducing additive in (C), is at least 25 minutes, said oxidative induction time measured using a high pressure differential scanning calorimeter after carrying out the steps comprising placing 5 mg of the friction reducing additive with 0.5 wt. % of a phenolic antioxidant having a thioether group relative to the friction reducing additive in a 40 μL aluminium crucible and heating the calorimeter from 30° C. to 170° C. at a rate of 50° C./min followed by maintenance of the temperature at 170° C. with an air pressure of 40 bar and air flow of 50 mL/min; and ii) the lubricant composition substantially maintains a friction coefficient over two cycles of a temperature range of 40-140° C. using a pin-on-ring tribometer.

16. The method of claim 15, wherein the Group III base has a viscosity at 100° C. of 4-8 $mm^2/s$, a viscosity index of at least 125 and a Noack evaporation loss of less than 15%.

17. The method of claim 15, wherein the lubricant composition further comprises as a minor component less than 30 wt. % of any or a mixture of Group I, II, IV, V, and/or Group VI base stocks and/or any or a mixture of Group III base stocks which have not been used as the major component in the base stock.

18. The method of claim 15, wherein the lubricant composition further comprises 5-20 wt. % of a Group V alkyl naphthalene or ester base stock.

19. The method of claim 15, wherein the lubricant composition comprises 0.1-1.5 wt. % of the partial polyol ester friction reducing additive.

20. The method of claim 15, wherein the lubricant composition comprises 0.5-1.5 wt. % of the saturated primary amide friction reducing additive.

21. The method of claim 15, wherein the lubricant composition comprises 0.1-2 wt. % of the saturated primary amide friction reducing additive.

22. The method of claim 15, wherein the lubricant composition comprises 0.1-1.5 wt. % of the partial polyol ester friction reducing additive and 0.5-1.5 wt. % of the saturated primary amide friction reducing additive.

23. The method of claim 15, wherein the lubricant composition comprises 0.5 wt. % of the partial polyol ester friction reducing additive and 0.5 wt. % of the saturated primary amide friction reducing additive.

24. The method of claim 15, wherein the lubricant composition further comprises as a minor component less than 15% of a viscosity index improver having a viscosity at 100° C. of 20 to 4000 $mm^2/s$.

25. The method of claim 15, wherein the partial polyol ester friction reducing additive is the reaction product of either glycerol or trimethylolpropane with a $C_{14}$-$C_{18}$ monocarboxylic acid having an iodine value of not more than 10 and a cloud point of not more than 45° C. wherein the product ester is a monoester or diester or a mixture thereof.

26. The method of claim 25, wherein the lubricant composition comprises 0.1-1.5 wt. % of the partial polyol ester friction reducing additive.

27. The method of claim 15, wherein the saturated primary amide friction reducing additive comprises a straight or branched chain $C_{14}$-$C_{18}$ aliphatic hydrocarbon group.

28. The method of claim 15, wherein the saturated primary amide friction reducing additive is isostearylamide.

29. The method of claim 15, wherein the ratio of partial polyol ester friction reducing additive to saturated primary amide friction reducing additive is 50:50 wt. %.

30. The method of claim 15, wherein the oxidative induction time of the friction reducing additive in (B), together with (C), is at least 30 minutes.

31. The method of claim 30, wherein the oxidative induction time of the friction reducing additive in (B), together with (C), is at least 35 minutes.

32. The method of claim 15, wherein the lubricant composition further comprises between 5 to 20 wt. % other additives, relative to the total weight of the lubricant composition.

* * * * *